US007828001B2

(12) United States Patent
Lamb

(10) Patent No.: US 7,828,001 B2
(45) Date of Patent: Nov. 9, 2010

(54) PAD WASHING SYSTEM WITH SPLASH GUARD

(76) Inventor: Douglas R. Lamb, 3690 County Rd. 10, Bellefontaine, OH (US) 43311

( * ) Notice: Subject to any disclaimer, the term of this patent is extended or adjusted under 35 U.S.C. 154(b) by 630 days.

(21) Appl. No.: 11/843,406

(22) Filed: Aug. 22, 2007

(65) Prior Publication Data

US 2008/0173337 A1 Jul. 24, 2008

Related U.S. Application Data

(60) Provisional application No. 60/886,203, filed on Jan. 23, 2007, provisional application No. 60/940,154, filed on May 25, 2007.

(51) Int. Cl.
*B08B 3/04* (2006.01)

(52) U.S. Cl. ..... 134/104.2; 134/140; 134/147; 134/157; 15/1; 15/104.92; 15/142; 15/257.01; 15/260

(58) Field of Classification Search ..... 134/104.2, 134/140, 147, 157; 15/1, 104.92, 142, 257.01, 15/260

See application file for complete search history.

(56) References Cited

U.S. PATENT DOCUMENTS

| | | | | |
|---|---|---|---|---|
| 2,088,650 | A | 8/1937 | Hartley | |
| 3,084,364 | A | 4/1963 | Hutchins | |
| 4,234,094 | A * | 11/1980 | Jorgensen | 211/88.01 |
| 4,597,126 | A | 7/1986 | Beech | |
| 4,948,078 | A * | 8/1990 | Dumenigo | 248/176.1 |
| 4,983,221 | A | 1/1991 | Kaiser | |
| 5,207,345 | A | 5/1993 | Stewart et al. | |
| 5,471,726 | A | 12/1995 | Kaiser | |
| 5,551,986 | A | 9/1996 | Jain | |
| 5,682,638 | A | 11/1997 | Kaiser | |
| 6,305,820 | B1 * | 10/2001 | Poon | 362/186 |
| 6,418,584 | B1 | 7/2002 | Teeny et al. | |
| 6,530,103 | B2 | 3/2003 | Pan et al. | |
| 6,562,142 | B2 | 5/2003 | Barger et al. | |
| 2002/0144712 | A1 | 10/2002 | Barger et al. | |
| 2005/0071942 | A1 * | 4/2005 | Akhtar | 15/257.01 |
| 2005/0081317 | A1 | 4/2005 | Olgin et al. | |
| 2005/0097690 | A1 | 5/2005 | Kaiser | |

FOREIGN PATENT DOCUMENTS

| | | |
|---|---|---|
| JP | 11204469 | 7/1999 |

* cited by examiner

*Primary Examiner*—Michael Barr
*Assistant Examiner*—David Cormier
(74) *Attorney, Agent, or Firm*—McNees Wallace & Nurick, LLC

(57) ABSTRACT

A pad washing system is provided. This system includes a filter device that further includes: a filter component having a textured top surface and at least one baffle formed on the underside thereof; a filter support apparatus adapted to receive the filter device, wherein the filter support apparatus further includes: a base, a plurality of vertical support columns formed integrally with the base, a plurality of caps mounted on top of the vertical columns, and a plurality of biasing members disposed between the caps and the tops of the vertical columns; a bucket for receiving both the filter device and the filter support apparatus; a threaded rim attached to or formed integrally with the top edge the bucket; and a splash guard mountable within the threaded rim.

12 Claims, 7 Drawing Sheets

SECTION F - F

PAD WASHING SYSTEM WITH SPLASH GUARD

CROSS-REFERENCE TO RELATED APPLICATIONS

This patent application claims the benefit of U.S. Provisional Patent Application Ser. No. 60/886,203 filed on Jan. 23, 2007 and entitled "Pad Washing System" and U.S. Provisional Patent Application Ser. No. 60/940,154 filed on May 25, 2007 and entitled "Pad Washing System with Splash Guard" the disclosures of which are incorporated by reference as if fully rewritten herein.

BACKGROUND OF THE INVENTION

The present invention relates generally to devices for cleaning pads of the type used with powered buffing machines, and more specifically to a system and apparatus for washing pads of the type mounted on rotary and orbital buffing and polishing machines.

Powered buffing and polishing machines are commonly used to clean and wax or polish the exterior of painted and/or clear-coated vehicles such as cars, trucks, boats, and the like. A cleaning or polishing pad is typically mounted on a powered rotary or orbital polisher and partially or wholly covered with cleaner, wax, or polish prior to use. As the pad is used, it accumulates cleaner, wax, or polish as well as dirt and debris from the item or items upon which it is being used. When a cleaning, waxing, or polishing job is complete, the pad should be cleaned before it can be used again. Cleaning such pads is often time consuming, difficult, and based on the method of cleaning is used, may be only partially effective. Commercially available pad washers are often mechanically complex, expensive, and unsuitable for use with different types of pads. Thus, there is a need for a system for cleaning pads of the type used with powered buffers and polishers that includes effective and consistent means for restoring such pads to useable condition following the actual use thereof.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a pad washing system is provided. This system includes a filter device, a support apparatus adapted to receive the filter device, a bucket for receiving the filter device and the support apparatus, and at least one pad, wherein the at least one pad is mounted on a powered buffing machine. The filter device further includes a filter component having at least one baffle formed on the underside thereof. The support apparatus further includes: a base; a plurality of vertical columns formed integrally with the base; a plurality of caps, wherein each cap in the plurality of caps is mounted on top of one of the vertical columns; and a plurality of biasing members, wherein each biasing member in the plurality of biasing members disposed between one of the caps and the top of one of the vertical columns. The system also includes at least one contoured pad cleaning insert, wherein the pad cleaning insert is adapted to be mounted on or in the filter device for providing a convex surface for cleaning pads.

In accordance with another aspect of the present invention, a pad washing apparatus is provided. This apparatus includes a filter device, a support apparatus adapted to receive the filter device, a bucket for receiving the filter device and the support apparatus, and a lid attachable to the top edge of the bucket, wherein the lid further includes a threaded rim portion and a removable insert mounted within the rim portion. The filter device further includes a filter component having a textured area formed on the top surface thereof and at least one baffle formed on the bottom side thereof. The support apparatus further includes: a base; at least one vertical support or column formed integrally with the base; at least one cap, wherein the cap is mounted on top of the at least one vertical column; and at least one biasing member, wherein the biasing member is disposed between the cap and the top the vertical columns. A wheeled cart may be included with this embodiment for facilitating transport of the pad washing apparatus.

In yet another aspect of this invention, a pad washing apparatus is provided. This apparatus includes a filter device, a support apparatus adapted to receive the filter device, a bucket for receiving the filter device and the support apparatus, a threaded rim attached to or formed integrally with the top edge the bucket, and a splash guard, wherein the splash guard is mountable within the threaded rim. The filter device further includes a filter component having at least one baffle formed on the underside thereof. The support apparatus further includes: a base; a plurality of vertical columns formed integrally with the base; a plurality of caps, wherein each cap in the plurality of caps is mounted on top of one of the vertical columns; and a plurality of biasing members, wherein each biasing member in the plurality of biasing members disposed between one of the caps and the top of one of the vertical columns. The splash guard further comprises: a threaded base; a first guard member formed integrally with the base; a second guard member movably attached to the first guard member; wherein the first and second guard members cooperate with one another to form a aperture of variable diameter through which at least one pad may be inserted for washing.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
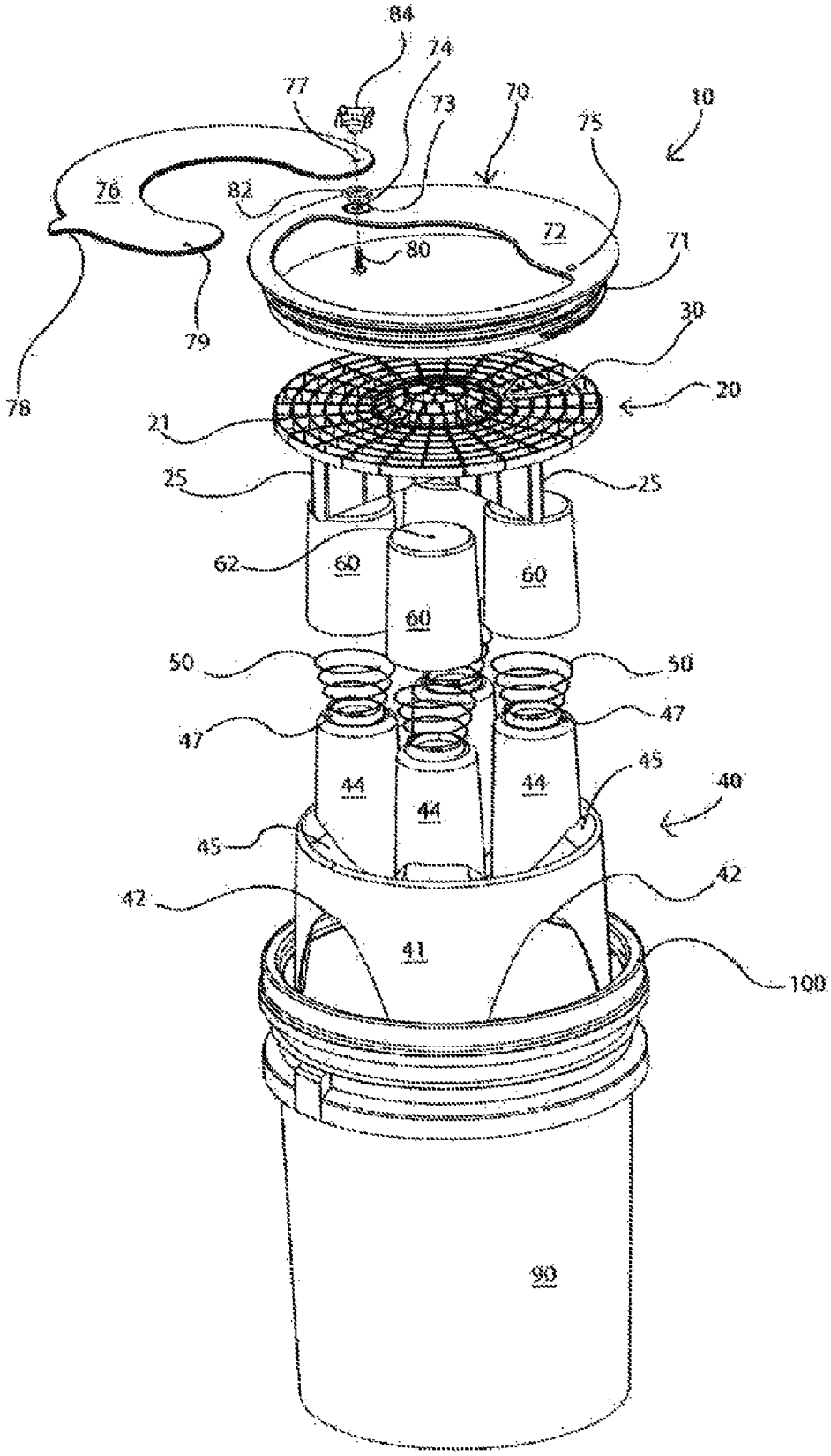
FIG. 1 is an exploded perspective view of an exemplary embodiment of the pad washing system of the present invention showing the splash guard, lid rim, cleaning insert, filter device, support apparatus, and bucket within which the system components are typically situated.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a system and apparatus for effectively washing and cleaning pads of the type used with powered rotary and orbital buffing and polishing machines. As previously indicated, a first general embodiment of this invention provides a integrated pad washing system; a second general embodiment of this invention provides a pad washing apparatus; and a third general embodiment of this invention provides a pad washing apparatus that includes a removable splash guard. With reference now to the Figures, one or more specific embodiments of this invention shall be described in greater detail.

Figure 2:
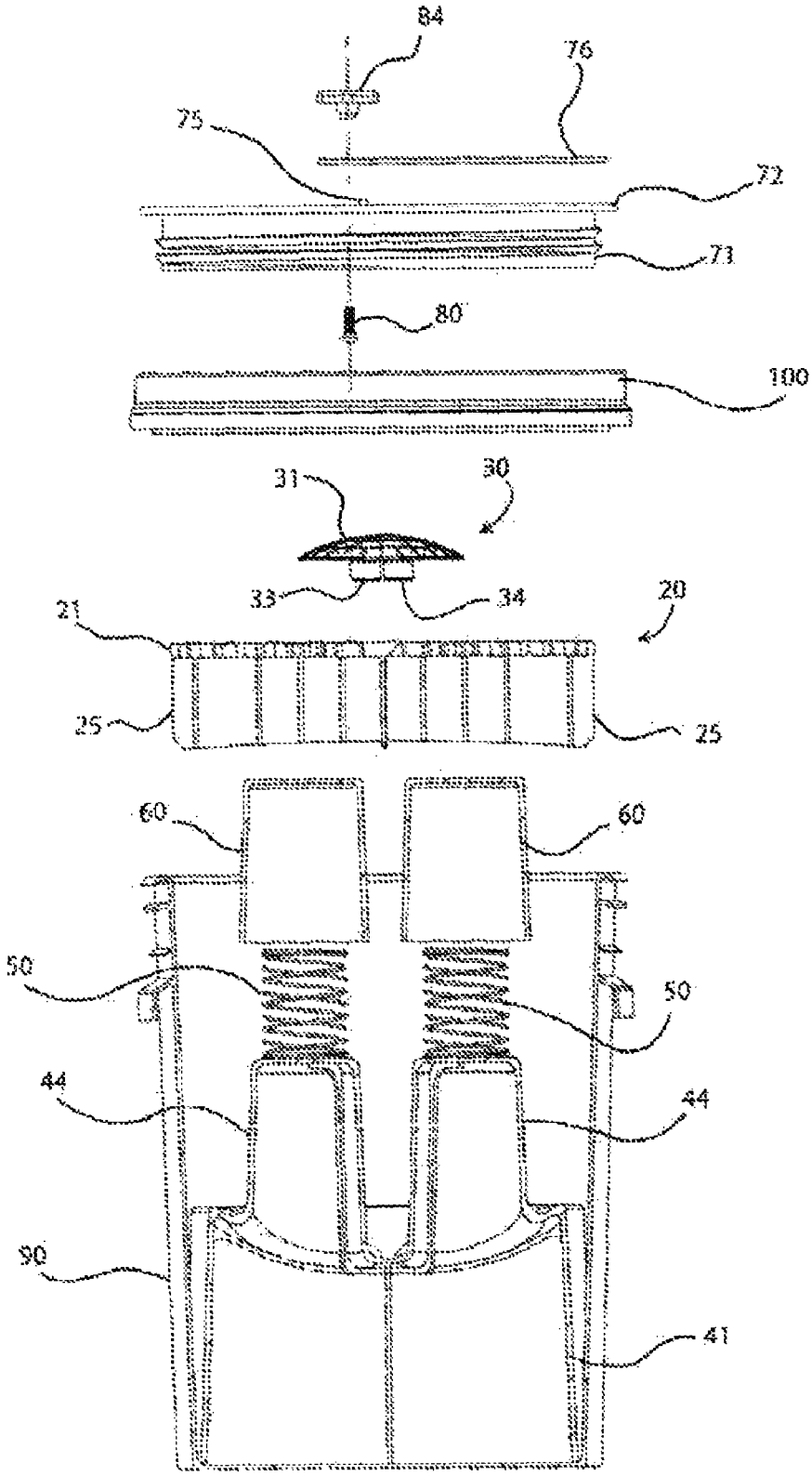
FIG. 2 is an exploded side view of the system of FIG. 1.
Figure 3:
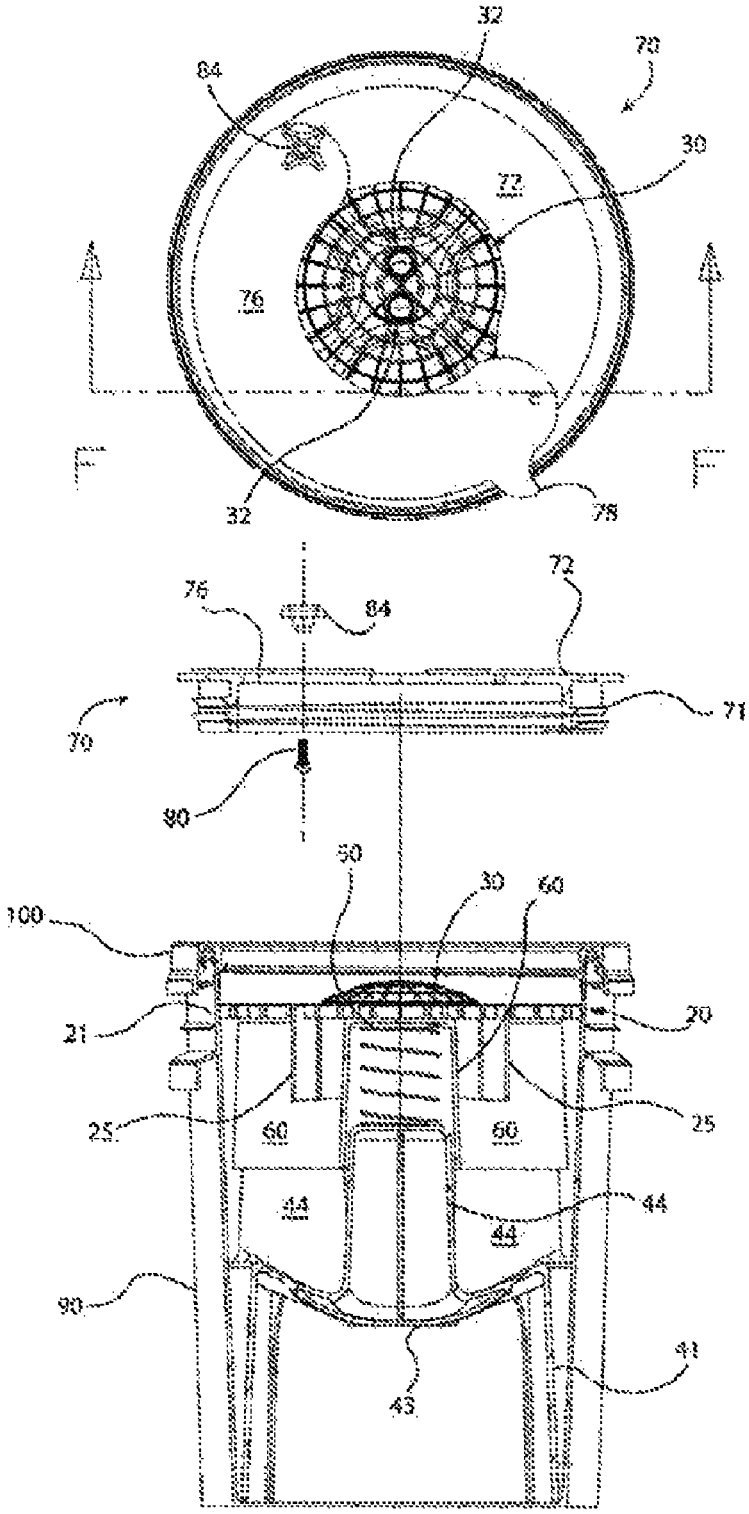
FIG. 3 includes top and side views of the splash guard component of the present invention as well a cross-sectional view of the lid rim, pad cleaning insert, filter device, and support apparatus positioned within a bucket.
Figure 4:
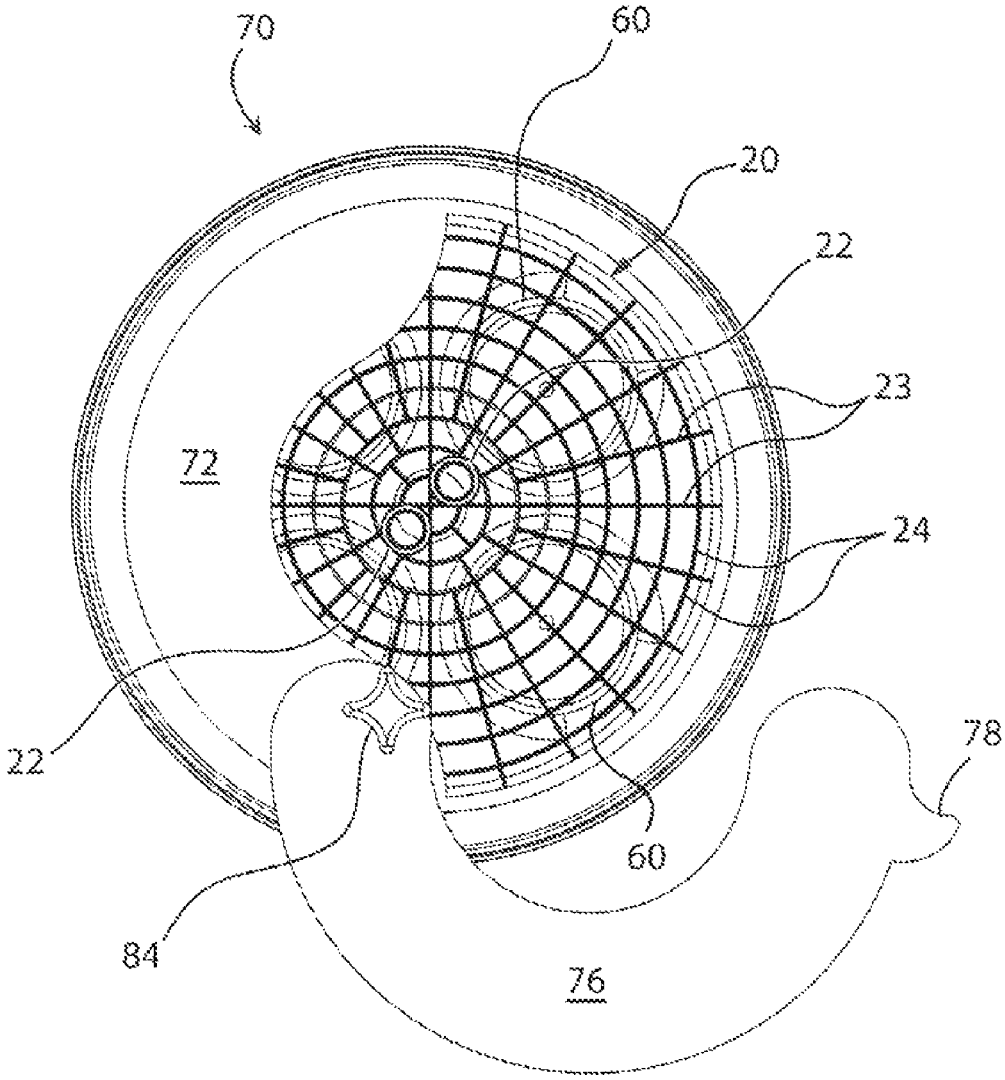
FIG. 4 is a top view of the splash guard component of the present invention showing the splash guard in the "open" position prior to placing a pad in the pad washing device.

FIGS. 1-7 provide various illustrative views of certain exemplary embodiments of the present invention. As best shown in FIGS. 1-3 pad washing system 10 includes filter device 20, optional pad cleaning insert 30, support apparatus 40, splash guard assembly 70, bucket 90, and lid rim 100. When system 10 is fully assembled and ready for use (see FIG. 3), filter device 20 rests within the top portion of support apparatus 40, and both system components sit inside bucket 90, which is typically filled (partially) with water or another solution. Optional pad cleaning insert 30, which includes cleaning surface 31, finger holes 32, first base portion 33 and second base portion 34 (which may be inserted into holes 22 formed in filter device 20), may be mounted in filter device 20. Lid rim 100 (without the lid insert) is threaded onto the top edge of bucket 90 and splash guard 70 is threaded onto lid rim 100. The lid rim and lid insert components of this invention may include or utilize portions of the lid assembly described in U.S. Pat. No. 5,207,345, which is incorporated by reference herein, in its entirety. Filter device 20 includes filter component 21 and baffles 25, which are formed on the underside of filter component 22. In one embodiment of this invention, the bucket insert (known as the GRIT GUARD) disclosed in U.S. Pat. No. 7,025,880, the entirety of which is incorporated by reference herein, is used as filter device 20. However, other geometric configurations of filter device 20 and support apparatus 40 are compatible with this invention.

Support apparatus 40 includes base 41, a plurality of vertical columns 44, a plurality of biasing members 50, and a plurality of caps 60. As shown in FIGS. 1-3, caps 60 are mounted on top of vertical columns 44, and springs or biasing members 50 are situated between the top edge of each vertical column 44 and the underside of each cap 60. Biasing members 50 allow the distance between the upper surface of filter device 20 and the bottom of bucket 40 to be temporarily reduced when downward pressure is applied to filter device 20. Biasing members 50 are typically metal or plastic springs or spring-like devices, but may also be resilient foam or another material that returns to its resting or neutral position after being compressed. In the exemplary embodiment shown in the Figures, the top edge of each vertical column 44 includes a retaining collar 47, which stabilizes each biasing member 50 therein. Biasing members 50 may include a tapered shape for greater compatibility with retaining collars 47 and caps 60. In some embodiments, biasing members 50 are formed integrally with either the vertical columns or the caps and form a unitary structure therewith. Vertical columns 44 and caps 60 cooperate with baffles 25 to prevent filter device 20 from rotating undesirably within bucket 90 when system 10 is in use. Each cap 60 includes an aperture 62 and each vertical column includes an aperture 46 for permitting water flow therethrough for general ease of use and overall enhanced system performance. The generally tapered internal geometry of base 41 also permits dirt and grit to pass through aperture 43 and into the bottom portion of bucket 50 wherein it is retained. In the exemplary embodiment of FIG. 1, each vertical column 44 further includes a cutaway portion 45 (note: each column typically terminates in a fillet where it joins base 41) for permitting or increasing the flow of water around the bottom portion of the column, and base 41 includes a plurality of cutaway portions 42 for permitting or increasing the flow of water into the bottom of bucket 90. In some embodiments, one or more anti-slip means 48 are included on the bottom edge of base 41 to reduce any tendency of base 41 to rotate within bucket 90 when system 10 is in use.

Figure 5A:
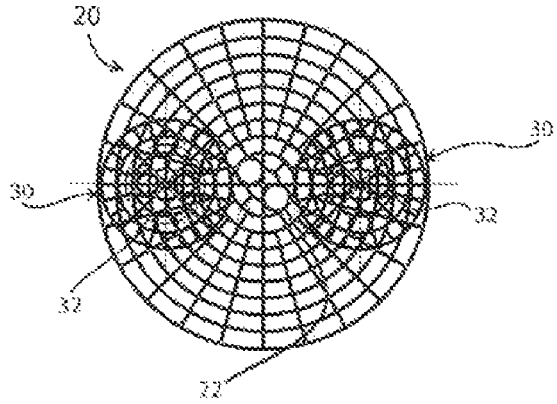
FIG. 5*a* is a top view of the filter device of the present invention shown with multiple cleaning inserts mounted thereon.
Figure 5B:
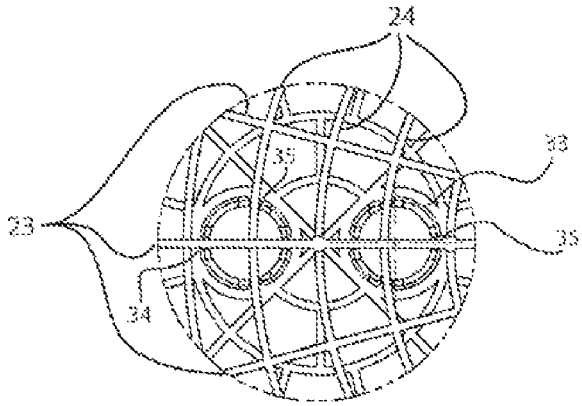
FIG. 5*b* is a partial bottom view of a pad cleaning insert mounted on the filter device showing the slots formed in the base portions of the pad cleaning insert and the placement of the radial grid members and the circular grid members within the slots.
Figure 5C:
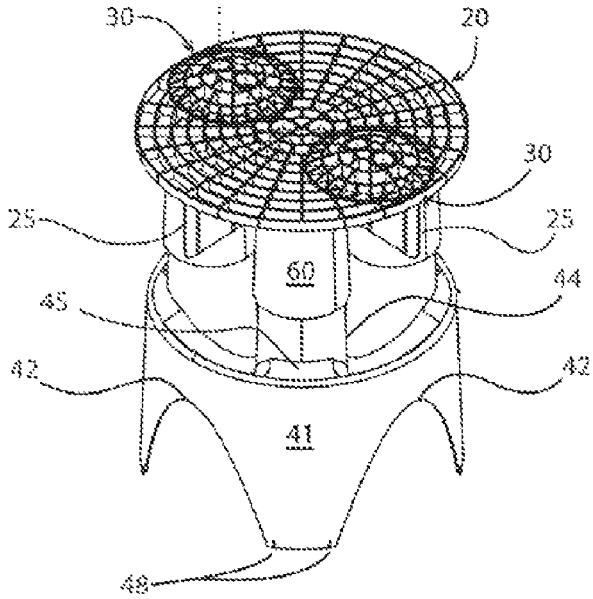
FIG. 5*c* is a perspective view of the filter device properly positioned on the support apparatus with two convex pad cleaning inserts mounted thereon.
Figure 6A:
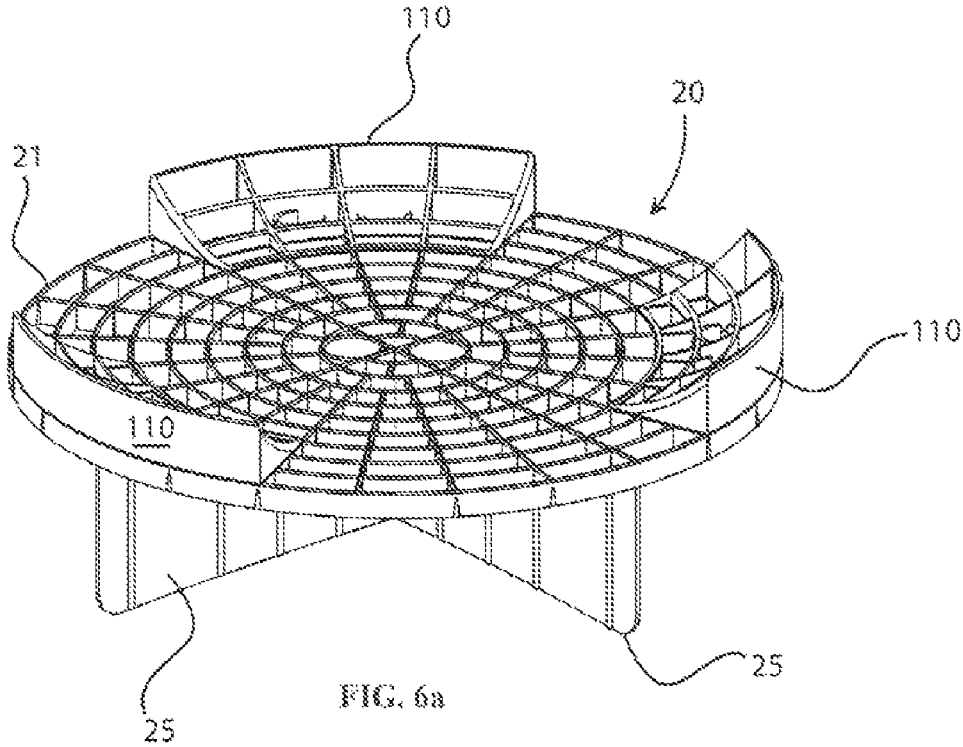
FIG. 6*a* is a perspective view of the filter device with three edge cleaning devices mounted thereon for cleaning the edges of a buffing pad.
Figure 6B:
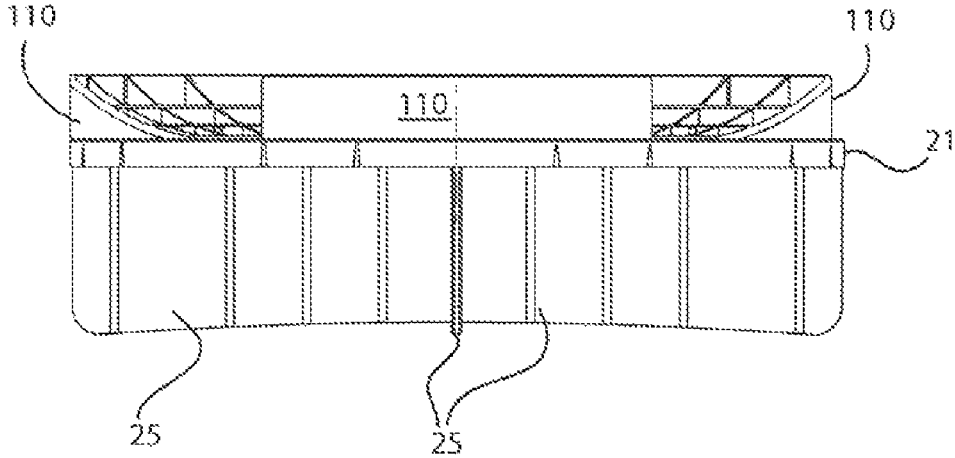
FIG. 6*b* is a side view of the filter device with three edge cleaning devices mounted thereon for cleaning the edges of a buffing pad.

Filter device 20 includes a grid portion through which dirt and debris may pass as a pad is being washed with system 10. The upper surface of filter component 21 provides single or multiple textured areas or regions over which a pad (or pads) is moved at a high rate of speed during the washing process. For pads that have a concave surface, the present invention includes an optional pad cleaning insert 30 that provides an additional textured cleaning surface 31, which is convex. As shown in FIG. 1, first and second base portions 33, 34 of insert 30 are generally cylindrical in shape and are inserted into the finger/thumb holes 22 in filter device 20. As shown in FIGS. 5*a*-5*b*, in an alternate embodiment of this invention, two cleaning inserts 30 are provided. These inserts mount directly onto the grid of filter device 20. As shown in FIG. 5*b*, filter device 20 includes radial grid members 23 and concentric circular grid members 24. A series of contoured slots 35 formed in first base portion 33 and second base portion 34 of insert 30 correspond to radial grid members 23 and concentric circular grid members 24 and permit inserts 30 to be mounted on filter device 20 in any of a number of desired locations. In the embodiment shown in FIG. 5*a*-*c*, contoured slots 35 allow insert 30 to be mounted on filter device 20 along the fourth and sixth concentric rings in 15 degree increments. Other configurations are possible. As shown in FIG. 6*a*-6*b*, some embodiments of this invention also include one or more edge cleaning inserts 110 that are mounted on filter device 20 for cleaning the edges of a pad as well as its bottom surface. Edge cleaning inserts 110 also include base portions that have contoured slots corresponding to certain radial grid members 23 and certain concentric circular grid members 24.

With reference to FIGS. 1-4, optional splash guard 70 includes a threaded body 71, which typically attaches to an internal threaded area of lid rim 100. The top, horizontal surface of splash guard 70 includes a first curved guard member 72, which is fixed in its position on body 71, and a second curved guard member 76, which is moveable and is attached to first guard member 72 by inserting carriage bolt 80 through apertures 74 and 77 and mounting knob 84 thereon. Knob 84 provides a means by which a user of system 10 may change the resistance between the guard members. A channel 73 may be formed in first guard member 72 and an o-ring 82 may be recessed therein (see FIG. 1) for creating additional resistance between the guard members to prevent second guard member 76 from swinging undesirably when system 10 is in use. In some embodiments, a protrusion 75 is included on the top surface of first guard member 72 for engaging a corresponding recess or depression 79 formed on the bottom side of second guard member 76. In another embodiment, protrusion 75 is formed on the bottom surface of second guard member 76 and depression 79 is formed in the top surface of first guard member 72 for reducing the likelihood of unwanted movement of second guard member 76 when system 10 is in use. A grasping means or handle 78 may be included on the free end of second guard member 76 for more easily moving splash guard 70 to the open position (see FIG. 4).

Figure 7:
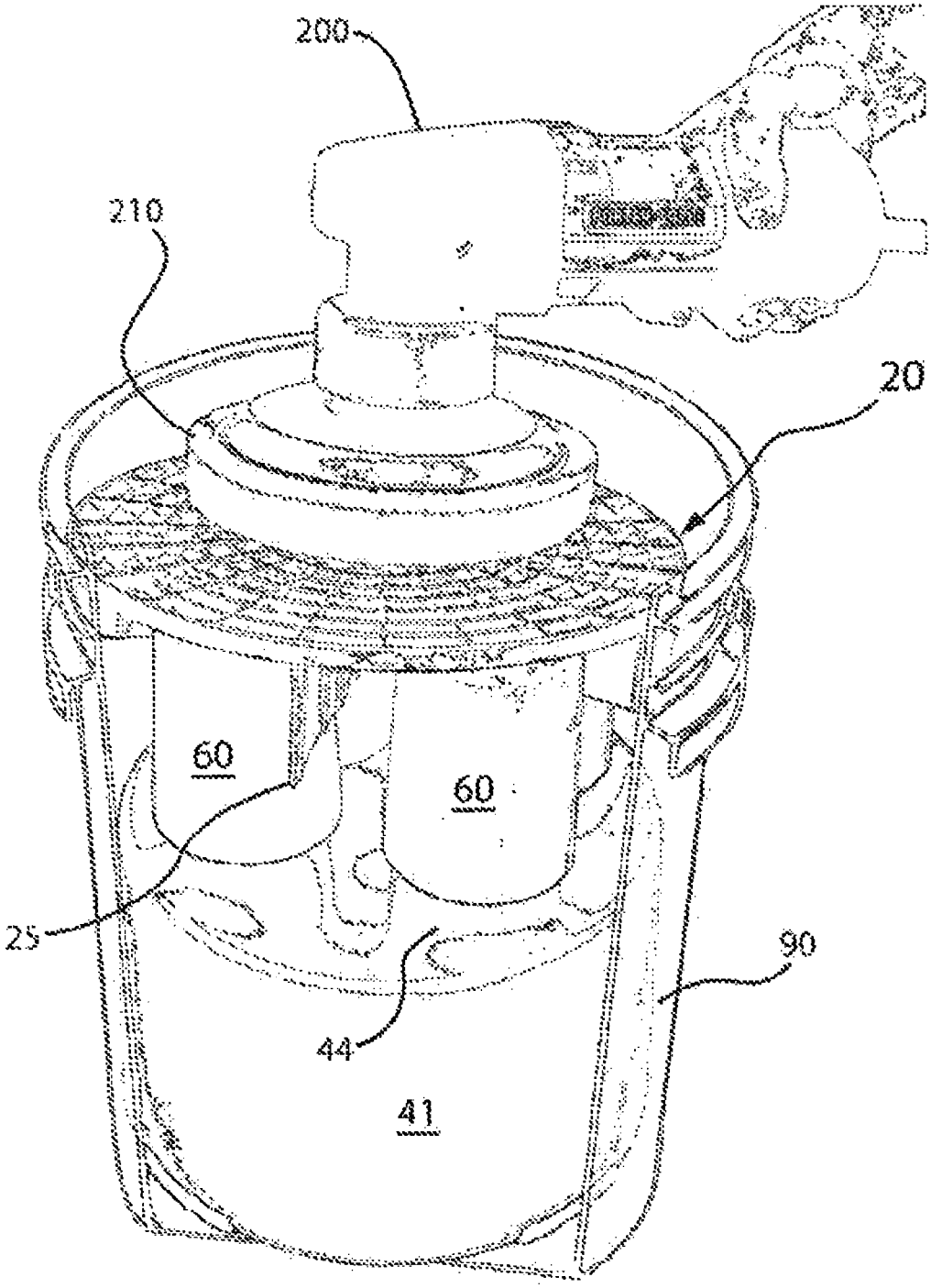
FIG. 7 is partial cutaway perspective view of an exemplary embodiment of the pad washing system of the present invention shown without the splash guard wherein a rotary polisher has been properly positioned on the filter device.

When in use, system 10 serves as a pad washing and cleaning device, i.e., it allows the user of a buffing, polishing, or cleaning pad (for automobiles and the like) 210 to effectively clean the pad without removing the pad from buffer/polisher 200 (see FIG. 7). In general terms, system 10 operates as follows. With filter device 20 and support apparatus 40 properly situated in bucket 90, bucket 90 is filled with water and a non-sudsing cleaning solution to a point just below filter device 20. The user of system 10 starts a powered buffer or polisher having a pad in need of cleaning mounted thereon and then depresses the pad against filter device 20. Filter device 20 drops slightly and pad 210 picks up water and cleaning solution. The surface of pad 210 and the surface of filter device 20 remain in relatively constant contact during the cleaning process. The application of uneven downward pressure does not typically cause filter device 20 to separate from the pad being cleaned due to the independent motion of caps 60 on vertical columns 44. The large surface area of filter device 20, allows system 10 to be used with both orbital polishers and non-orbital polishers. As a user moves the polisher and pad across the surface of filter device 20, the surface texture of filter device 20 effectively cleans the pad by friction and by means of a hydraulic pumping action. As previously stated, when insert 30 is mounted on filter device 20, an additional cleaning surface is provided that is especially useful for certain pads that include concave or irregular surfaces. Some embodiments of insert 30 include a plurality of cleaning bristles or other raised structures that further facilitate cleaning pads with concave or non-uniform surfaces. When splash guard 70 is installed as part of system 10, the user of the system simply moves second guard member 76 into the open position (see FIG. 4), inserts the pad (attached to the polisher), and then moves second guard member 76 back to the closed position (see FIG. 3) prior to starting the polisher. To dry the pad, the user simply reduces the downward pressure on the polisher, thereby allowing filter device 20 to automatically return to a position above the waterline in bucket 90. The user may then activate polisher 200 and spin pad 210 dry prior to opening splash guard 70 and removing the polisher from cleaning system 10.

Regarding use of the system of the present invention, the unique geometry of filter device 20 and the opening created by splash guard members 72 and 76, makes system 10 compatible with a variety of polishers, air grinders, drills, etc. that are equipped with polishing pads or other types of pads. Orbital polishers, rotary polishers, and polishers having elliptical motion or multiple cleaning heads are also compatible with this invention. Furthermore, the textured surface area of cleaning device 20 "conditions" the pad that is being cleaned by removing any loose or broken fibers from the pad. Thus, the present invention provides a highly effective and useful system and apparatus for cleaning pads of the type used with a variety of powered devices.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A pad washing system, comprising:

(a) a filter device, wherein the filter device further includes:

(i) an upper portion, wherein the upper portion further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface; and (ii) a lower portion, wherein the lower portion includes two intersecting baffles formed thereon at right angles to the upper portion, and wherein the intersecting baffles create four separate regions on the lower portion; and (b) a support apparatus adapted to sit in the bottom of a bucket and receive the filter device, wherein the support apparatus further includes:

(i) a base, wherein the base further includes a drainage aperture centrally formed therein and a plurality of cutaway sections formed in the bottom portion thereof;

(ii) a plurality of vertical columns formed integrally with the base;

(iii) a plurality of caps, wherein each cap is mounted on top of one of the vertical columns and supports one of the four separate regions on the lower portion of the filter device; and (iv) a plurality of compressible springs, wherein each spring is disposed between one of the caps and the top of one of the vertical columns.

2. The system of claim 1, further comprising a splash guard, wherein the splash guard is adapted to be mountable on the top edge of a bucket, and wherein the splash guard further comprises:

(a) a base;

(b) a static guard member formed integrally with the base;

(c) a moveable guard member pivotally attached to the static guard member;

(d) wherein the guard members cooperate with one another to form a variable aperture through which at least one pad may be inserted for washing.

3. The system of claim 2, further comprising a threaded rim attached to or formed integrally with the top edge the bucket.

4. The system of claim 3, wherein the splash guard is adapted to be detachably mountable within the threaded rim.

5. The system of claim 1, further comprising at least one domed pad cleaning insert adapted to be mounted on top of the filter device for providing at least one raised cleaning surface, wherein the pad cleaning insert further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface.

6. A pad washing apparatus, comprising:

(a) a filter device, wherein the filter device further includes:

(i) an upper portion, wherein the upper portion further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface; and (ii) a lower portion, wherein the lower portion includes two intersecting baffles formed thereon at right angles to the upper portion, and wherein the intersecting baffles create four separate regions on the lower portion; and (b) a support apparatus adapted to sit in the bottom of a bucket and receive the filter device, wherein the support apparatus further includes:

(i) a base, wherein the base further includes a drainage aperture centrally formed therein and a plurality of cutaway sections formed in the bottom portion thereof;

(ii) a plurality of vertical columns formed integrally with the base, wherein each vertical column further includes an aperture passing through the top portion thereof;

(iii) a plurality of caps wherein each cap further includes an aperture formed in the top portion thereof, is mounted on top of one of the vertical columns, and supports one of the four separate regions on the lower portion of the filter device; and (iv) a plurality of compressible springs wherein each spring is disposed between one of the caps and the top of one of the vertical columns; and (c) a bucket for receiving both the filter device and the support apparatus; and (d) a lid attachable to the top edge of the bucket, wherein the lid further includes a threaded rim portion and a removable insert mounted within the threaded rim portion.

7. The apparatus of claim 6, further comprising a splash guard, wherein the splash guard is mountable within the threaded rim, and wherein the splash guard further comprises:

(a) a threaded base;

(b) a static guard member formed integrally with the base;

(c) a moveable guard member pivotally attached to the static guard member;

(d) wherein the guard members cooperate with one another to form a variable aperture through which at least one pad may be inserted for washing.

8. The apparatus of claim 6, further comprising at least one domed pad cleaning insert adapted to be mounted on top of the filter device for providing at least one raised cleaning surface, wherein the pad cleaning insert further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface.

9. A pad washing apparatus, comprising:

(a) a filter device, wherein the filter device further includes:

(i) an upper portion, wherein the upper portion further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface; and (ii) a lower portion, wherein the lower portion includes two intersecting baffles formed thereon at right angles to the upper portion, and wherein the intersecting baffles create four separate regions on the lower portion; and (b) a support apparatus adapted to sit in the bottom of a bucket and receive the filter device, wherein the support apparatus further includes:

(i) a base, wherein the base further includes a drainage aperture centrally formed therein and a plurality of cutaway sections formed in the bottom portion thereof;

(ii) a plurality of vertical columns formed integrally with the base, wherein each vertical column further includes an aperture passing through the top portion thereof and a raised collar formed around the aperture;

(iii) a plurality of caps, wherein each cap is mounted on top of one of the vertical columns and supports one of the four separate regions on the lower portion of the filter device; and (iv) a plurality of compressible springs, wherein each spring is disposed between one of the caps and the top of one of the vertical columns;

(c) a bucket for receiving both the filter device and the support apparatus;

(d) a threaded rim attached to or formed integrally with the top edge the bucket; and (e) a splash guard, wherein the splash guard is mountable within the threaded rim, and wherein the splash guard further comprises:

(i) a threaded base;

(ii) a static guard member formed integrally with the base;

(iii) a moveable guard member pivotally attached to the static guard member;

(iv) wherein the guard members cooperate with one another to form a variable aperture through which at least one pad may be inserted for washing.

10. The apparatus of claim 9, further comprising at least one domed pad cleaning insert adapted to be mounted on top of the filter device for providing at least one raised cleaning surface, wherein the pad cleaning insert further includes a plurality of intersecting radial grid members and concentric circular grid members across the entire surface area thereof, wherein the radial grid members and circular grid members define a plurality of apertures formed at regular intervals therebetween, and wherein the radial grid members and circular grid members are operative to provide a textured cleaning surface.

11. The apparatus of claim 9, wherein the base of the filter support apparatus further comprises anti-slip means attached to or formed integrally with the bottom edge thereof for reducing movement of the filter support apparatus within the bucket.

12. The apparatus of claim 9, wherein the static guard member further comprises a grasping portion formed thereon.

* * * * *